US005509944A

United States Patent [19]

Venkatadri et al.

[11] Patent Number: 5,509,944

[45] Date of Patent: Apr. 23, 1996

[54] STABILIZATION OF GASOLINE AND GASOLINE MIXTURES

[75] Inventors: Ramray A. Venkatadri; R. G. Presenti, both of Houston, Tex.

[73] Assignee: Exxon Chemical Patents Inc., Linden, N.J.

[21] Appl. No.: 287,783

[22] Filed: Aug. 9, 1994

[51] Int. Cl.[6] ..... C10L 1/24

[52] U.S. Cl. ..... 44/430; 44/435; 44/450

[58] Field of Search ..... 44/430, 435, 450; 252/48.2

[56] References Cited

U.S. PATENT DOCUMENTS

| | | | |
|---|---|---|---|
| 2,395,382 | 2/1946 | Walters | 44/430 |
| 2,677,617 | 5/1954 | Thompson | 44/435 |
| 2,918,361 | 12/1959 | Chenicek et al. | 44/430 |
| 2,932,560 | 4/1960 | Mills | 44/435 |
| 3,404,087 | 10/1968 | Scoggins et al. | 44/430 |
| 3,839,210 | 10/1974 | Beiswanger | 44/435 |
| 4,011,057 | 3/1977 | Sayers | 44/450 |
| 4,246,125 | 1/1981 | Papay et al. | 44/435 |
| 4,469,586 | 9/1984 | Ferm | 208/48 AA |
| 4,744,881 | 3/1988 | Reid | 208/48 AA |
| 4,981,495 | 1/1991 | Reid | 44/333 |
| 5,169,410 | 12/1992 | Wright | 44/415 |

*Primary Examiner*—Margaret Medley
*Attorney, Agent, or Firm*—Robert L. Graham

[57] ABSTRACT

Gasoline and gasoline mixtures containing unsaturated hydrocarbons are stabilized by the addition thereto of an effective amount of (a) a primary antioxidant of a phenylenediamine, a hindered monophenol, or mixtures thereof, and (b) dimethyl sulfoxide.

1 Claim, No Drawings

STABILIZATION OF GASOLINE AND GASOLINE MIXTURES

BACKGROUND OF THE INVENTION

This invention relates to the stabilization of gasoline mixtures using antioxidants. In one aspect, the invention relates to the stabilization of pyrolysis gasoline. In still another aspect, the invention relates to the stabilization of pyrolysis gasoline using a primary antioxidant and a secondary antioxidant.

Pyrolysis gasoline (Pygas) is produced by the steam cracking of heavy naphthas or gas oils to produce ethylene with Pygas being the byproduct of this process. The Pygas is high in unsaturated hydrocarbons and is used as a feedstock for petrochemical processes or is blended to produce motor gasoline. Because of the presence of the unsaturated hydrocarbons, the tendency of the Pygas to foul is high. Oxygen contamination leads to the formation of intermediate peroxides and this in combination with the unsaturated hydrocarbons produces high molecular weight polymeric gums.

It is common practice to add to polymers, petroleum products, and food, antioxidants to retard oxidation. The two most common classes of antioxidants are the primary antioxidants and secondary antioxidants. The primary antioxidants include the phenylenediamines and hindered phenols and the secondary antioxidants generally include the phosphites and on infrequent occasions sulphur compounds such as thioethers and esters of thiodipropionic acid. The combination of antioxidants imparts multifunctionality to the treatment. The primary antioxidant functions as a free-radical scavenger, and the secondary antioxidants decompose hydroperoxides.

Antioxidants have been used in stabilizing gasoline and hydrocarbon streams. Kirk-Othmer Encyclopedia of Chemical Technology, Vol. 3, page 437, 3rd edition, discloses the use of butylphenols, cresols, and phenylenediamines as fuel and lubricant stabilizers. U.S. Pat. No. 4,469,586 discloses the use of saturated sulfoxide in a hydrocarbon stream to reduce fouling in heat exchangers. U.S. Pat. No. 4,981,495 discloses the use of an alkyl 1,2-dihydroquinoline compound along with a hindered phenol in gasoline mixtures. U.S. Pat. No. 4,744,881 discloses the use of nonhindered or partially hindered phenols in combination with a strongly basic material such as an organo amine for use in pyrolysis gasoline and other hydrocarbons. U.S. Pat. No. 5,169,410 discloses the use of phenylenediamines in combination with a strongly basic organic amine in the stabilization of gasoline.

As noted above, the secondary antioxidants used in a variety of applications include the phosphites and certain sulfur compounds such as sulfides. For environmental and operational reasons, discussed below, these compounds cannot be used with gasolines. Phosphites create undesirable side effects such as a decrease in the reactor catalyst activity by phosphorus poisoning. Moreover, phosphites are disallowed in finished gasoline. The sulfur compounds have not been used in the treatment of gasoline because of concern with exceeding the EPA limit of 50 ppm of sulfur in the gasoline.

Thus, there is a need for inexpensive and effective secondary antioxidants that can be used with primary antioxidants to stabilize Pygas and other gasolines containing unsaturated hydrocarbons (e.g. olefins).

SUMMARY OF THE INVENTION

Gasoline containing unsaturated hydrocarbons are treated with an effective amount of an antioxidant blend composition comprising (a) a primary antioxidant selected from amine antioxidants (phenylamines and diamines), and/or hindered phenols, and (b) a dialkylsulfoxide. The preferred blend comprises phenylenediamine, hindered phenol, and a dialkylsulfoxide.

The method for using the antioxidant composition comprises introducing the composition into the gasoline, at concentrations ranging from 10 to 500 ppm, preferably not more than 100 ppm. The method preferably is applied in the treatment of pyrolysis gasoline or gasolines containing pyrolysis gasoline.

The primary antioxidant and the secondary antioxidant may be added to the gasoline as a formulation or may be added separately.

DESCRIPTION OF THE PREFERRED EMBODIMENTS

As indicated above, the antioxidant composition for gasoline comprises a primary antioxidant and a secondary antioxidant. The primary antioxidants are selected from the group consisting of amine antioxidants and hindered phenol antioxidants and combinations thereof.

The amine antioxidants include the diarylamines and the alkylated-p-phenylenediamines. The commercial antioxidants within these classes are listed on Table 4 of the Kirk-Othmer Encyclopedia of Chemical Technology 3rd Edition, Volume 3, pages 442–444, the disclosure of which is incorporated herein by reference.

The preferred primary antioxidants are the alkylated-p-phenylenediamines having the following formula.

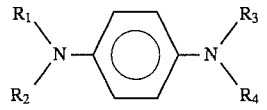

where $R_1$, $R_2$, $R_3$, and $R_4$ are the same or different and are H, alkyl, aryl, or alkaryl groups having from 1 to carbon atoms, and wherein at least one R group is H. Preferably, each N has bonded thereto at least one alkyl group (e.g. $R_1$ and $R_3$).

The alkyl, alkaryl groups may be straight or branched chain groups and preferably contain from 1 to 10 carbon atoms.

The phenylenediamine antioxidants include:

N-phenyl-N'-(1,3-dimethyl-butyl)-p-phenylenediamine
N-phenyl-N'-isopropyl-p-phenylenediamine
N,N'-di-sec-butyl-p-phenylenediamine*
N-phenyl-N'-(1-methylheptyl)-p-phenylenediamine
N-phenyl-N'-cyclohexyl-p-phenylenediamine
N,N'-diphenyl-p-phenylenediamine
N,N'-di-p-naphthyl-p-phenylenediamine
N,N'-bis(1,4-dimethyl-pentyl)phenylenediamine
N,N'-bis(1-ethyl-3-methyl-pentyl)-p-phenylenediamine*
N-1,3-dimethylbutyl-N'-phenyl-p-phenylenediamine
N-N'-bis(1-methylheptyl)-p-phenylenediamine
N-phenyl-N'-(p-toluene-sulfonyl)-p-phenylenediamine

*the preferred phenylenediamine antioxidants

The hindered phenol antioxidants include the monophenols, diphenols, and the polyphenols. These antioxidants are listed on Table 4 of the above referenced Kirk-Othmer Encyclopedia of Chemical Technology, the Table 4 listings being incorporated herein by reference.

The preferred hindered phenol antioxidants are the monophenols having the following general formula:

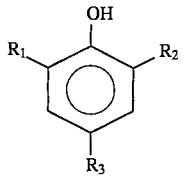

where $R_1$ and $R_2$ are the same or different and are alkyl groups, straight chain or branched;having from 1 to 6 carbon atoms, preferably 1 to 4 carbon atoms. $R_3$ is H or an alkyl group, straight chain or branched having from 1 to 6 carbon atoms, preferably 1 to 4 carbon atoms. Preferably $R_1$ and $R_2$ are tert. butyl groups, and $R_3$ is H or a tert. butyl group.

Specific examples are:

2,6-di-tert-butylphenol*
2,6-di-tert-butyl-4-methylphenol
2,6-di-tert-butyl-4-ethylphenol
2,6-di-tert-butyl-4-nonylphenol
2-tert-butyl-4,6-dimethylphenol
2,4,6 tri-tert-butylphenol*
mixture of 2,6-di-tert and tri-tert-butylphenol in 2,6-di-tert weight ratio ranging from 1:4 to 4:1*

*the preferred phenols.

The secondary antioxidant used in the present invention is a dialkylsulfoxide wherein each alkyl group contains from 1 to 6 carbon atoms. The preferred sulfoxide is dimethylsulfoxide (DMSO). This material is available commercially. For example, DMSO is marketed by Gaylord Chemicals as a solvent.

The formulation blend of the antioxidants (actives) may be as follows:

| | Range (wt %) | Preferred Range (wt %) | Most Preferred Range (wt %) |
|---|---|---|---|
| Primary antioxidant (amine and/ or phenol) | 40–99 | 60–99 | 80–99 |
| Secondary antioxidant (dialkyl-sulfoxide) | 1–60 | 1–40 | 1 to 20 |

The concentration of the DMSO in the formulation and the amount of the DMSO in the gasoline should preferably result in less than 5 ppm of sulfur in the final motor gasoline.

The amine antioxidant or phenol antioxidant may constitute 100% of the primary antioxidant, but preferably each will be present in the primary antioxidant in a 10:90 to 90:10 wt ratio, preferably a 30:70 to 70:30 wt ratio, most preferably 60 to 60:40 wt ratio.

The antioxidants in the blend may be used in neat form or in a solvent such as aromatic solvents. In the formulation containing a solvent, the solvent should comprise from 10 to 70 wt %, preferably 20 to 50 wt % thereof.

Other additives in the formulation may include metal deactivators.

In operation, the antioxidants formulation is introduced into the gasoline at any convenient location. In the preferred embodiment, the antioxidant formulation is used to treat Pygas. Pygas normally is processed through a hydrotreater prior to being blended with other gasolines to form motor gasoline. The antioxidant formula may be introduced into the gasoline upstream, but preferably downstream of the hydrotreater before the Pygas is mixed with other gasolines. The treatment concentration should be sufficient to inhibit gum formation and inhibit oxidation and stability. The formulation (actives) concentration in the gasoline should be between 10 to 500 ppm.

Additional antioxidant can be added downstream of the gasoline mixing vessel if desired.

In the treatment of other gasolines (e.g. dimate gasoline, cat cracked gasoline, etc.) the antioxidant formulation or the components may be introduced at any location downstream of the unit at the same treatment dosage described above.

EXPERIMENTS

The following examples demonstrate the effectiveness of the antioxidant blend used in accordance with the present invention.

Series I Experiments

A highly unstable Pygas containing 11.2% olefins was prepared by adding 250 ppm cumene hydroperoxide to the Pygas. Various samples of this composition were subjected to test procedure in accordance with ASTM D525 and gum formation in accordance with ASTM D873. The various tests were carried out by placing the Pygas sample in a bomb which is closed and subjected to 100 psig oxygen pressure. The bomb is then heated in a water bath to about 100° C. until a drop in pressure is noted signifying a loss of antioxidant activity. The period of time elapsed until the pressure drop is indicated is referred to as "Induction Time". The longer induction times thus signify increased stabilizer effectiveness.

The gum formation tests in accordance with ASTM D873 were as follows. As above, the gasoline is oxidized under 100 psig, 100° C. in a bomb filled with oxygen. After 4 hours the bomb is opened and the amounts of soluble gum, insoluble gum, and precipitate are weighed. "Potential gum" is the total of the soluble and insoluble gums.

The samples tested contained from 0 to 100 ppm of the antioxidant.

The Pygas samples tested were as follows:

Sample A: Untreated
Sample B: Di-sec-butyl-p-phenylene diamine (PDA)
Sample C: Tertiary butyl phenol (phenol) and PDA (a 50% blend of each)
Sample D: A blend of dimethyl sulfoxide (DMSO), PDA, and phenol, blended in a wt ratio of 10:50:40.

The results are presented in TABLE I.

TABLE I

| Sample | Dosage (ppm) | Potential Gums (mg/100 ml) | Induction Time (min) |
|---|---|---|---|
| A | — | 1302.1 | 60 |
| B (PDA) | 75 | 25.8 | 240+ |
| C (phenol) PDA) | 75 | 19.2 | 240+ |
| D (DMSO, PDA, phenol) | 75 | 13.2 | 240+ |

As can be seen by the potential gum data in TABLE I, the blend (Sample D) gave the best results.

Series II Experiments

Additional tests were carried out to determine the effects of aging on the samples at severe conditions. The Pygas samples (prepared as described in the Series I tests) with and without antioxidants were placed in a bomb and heated to 350° F. Following the aging tests, each sample was cooled and divided into two portions. One portion was used to measure the existent gum (ASTM D-381) resulting from the aging conditions, and the other was used to measure the induction time per ASTM D-525. The results of these tests are presented in TABLE II.

TABLE II

| Sample | Dosage (ppm) | Existent Gums (mg/100 ml) | Induction Time (min) |
|---|---|---|---|
| A | 0 | 66.6 | 45 |
| D | 30 | 30.2 | 110 |
| D | 60 | 6.2 | 270 |
| D | 100 | 4.0 | 365 |

Series III Experiments

Pygas samples containing unsaturated compounds (Bromine number of 50 g/100 g as determined by ASTM D-1159) were subjected to induction time tests in accordance with ASTM D- 525. The Pygas samples tested were as follows:

| Samples | Pygas Treatment | Wt Ratio of Antioxidant Blends |
|---|---|---|
| Sample E | Untreated | |
| Sample F | PDA | |
| Sample G | PDA/phenol | 50:50 |
| Sample H | PDA/phenol/DMSO | 20:60:20 |
| Sample I | PDA | |
| Sample J | PDA/phenol | 50:50 |
| Sample K | PDA/phenol/DMSO | 20:60:20 |

The results of the Series III Experiments are presented in Table III.

TABLE III

| Sample | Dosage (ppm) | Induction Time (min) |
|---|---|---|
| E | | 38 |
| F (PDA) | 100 | 231 |
| G (PDA/phenol) | 100 | 255 |
| H (PDA/Phenol/DMSO) | 100 | 265 |
| I (PDA) | 150 | 254 |
| J (PDA/phenol) | 150 | 365 |
| K (PDA/phenol/DMSO) | 150 | 338 |

The Series III Experiments reveal that the antioxidant formulation with DMSO at a dosage of 100 ppm was more effective than PDA or the PDA/phenol blend at the same concentration indicating a synergistic effect resulting from the presence of DMSO. At 150 ppm the synergistic effect does not appear. It is believed that the effect of the DMSO is masked by the relatively high dosage of the formulation.

Series IV Experiments

Product gasoline from the effluent of a Pygas hydrotreater was combined with a small quantity of feed to the unit in a volume ratio of 97:3 to simulate highly unstable fuel. This stream was further treated with 100 ppm cumene hydroperoxide to simulate conditions for exposure of fuel to oxygen in unblanketed storage tanks. The olefin content was 10.6%

The Pygas samples tested were as follows:

| Sample | Antioxidant | Wt Ratio of Antioxidant Blends |
|---|---|---|
| L | Untreated | |
| M | Phenol | |
| N | DMSO | |
| O | PDA | |
| P | PDA/Phenol | 50:50 |
| Q | PDA/DMSO | 50:50 |
| R | Phenol/DMSO | 50:50 |
| S | PDA/Phenol/DMSO | 50:45:5 |

The samples were tested in accordance with ASTM D-873 to determine potential gums. The test results are presented in Table IV.

TABLE IV

| Sample | Inhibitor | Dosage (ppm) | Potential Gums (mg/100 ml) |
|---|---|---|---|
| L | No treatment | — | 1950.3 |
| M | Phenol | 50 | 1501.3 |
| N | DMSO | 50 | 1703.7 |
| O | PDA | 50 | 49.1 |
| P | PDA/Phenol | 50 | 45.1 |
| Q | PDA/DMSO | 50 | 108.9 |
| R | Phenol/DMSO | 50 | 1562.6 |
| S | PDA/Phenol/DMSO | 50 | 30.6 |

It is interesting to note from the Table IV data that while DMSO alone (Sample N) is not very effective, when combined with the other two antioxidants (Sample S) it became quite effective, the most effective blend tested.

The synergy resulting from the use of DMSO with a primary antioxidant is exemplified in the tests of Samples Q (PDA/DMSO) and S (PDA/Phenol/DMSO). One would expect the 50/50 blend of PDA and DMSO would produce about 875 mg/100 ml of gum. The results were surprisingly low (108.9 mg/100 ml). The cost advantage of DMSO in comparison with PDA results in savings even if small but significant amounts of the DMSO can replace the PDA.

More surprising were the results obtained with the PDA/Phenol/DMSO blend. The three component antioxidant gave by far the best results, indicating a synergistic relationship of all three components.

Although the present invention has been described and demonstrated with respect to Pygas treatments, it should be understood that the invention may also have application with any type of gasoline which exhibits fouling caused by unsaturated components and oxidation.

What is claimed is:

1. A method of treating gasoline containing unsaturated hydrocarbons to inhibit gum formation which comprises introducing into the gasoline from 10 to 100 ppm of antioxidant components comprising (a) from 80 to 99 wt % of a blend of a di-sec-butyl-p-phenylenediamine and a 2,4,6 tert. butyl phenol, and (b) from 1 to 20 wt % of dimethylsulfoxide, the sulfur of the dimethylsulfoxide being present in the gasoline at a concentration less than 5 ppm.

* * * * *